US006142472A

United States Patent [19]

Kliebisch

[11] Patent Number: 6,142,472

[45] Date of Patent: Nov. 7, 2000

[54] CORPORATE LADDER GAME

[76] Inventor: Henry Kliebisch, 600 Mountain Ave., North Caldwell, N.J. 07006

[21] Appl. No.: 09/260,094

[22] Filed: Mar. 2, 1999

[51] Int. Cl.[7] ..... A63F 3/00

[52] U.S. Cl. ..... 273/236; 273/249; 273/430

[58] Field of Search ..... 273/236, 237, 273/241, 242, 248, 249, 292, 429, 430, 431

[56] References Cited

U.S. PATENT DOCUMENTS

| | | |
|---|---|---|
| 506,797 | 10/1893 | Ritz . |
| 1,208,992 | 12/1916 | Leonard . |
| 1,282,149 | 10/1918 | Trippe . |
| 1,536,672 | 5/1925 | Hobbs . |
| 3,643,957 | 2/1972 | Bryant . |
| 4,046,381 | 9/1977 | Comeaux . |
| 4,095,799 | 6/1978 | Stringer . |
| 4,201,388 | 5/1980 | Cantelon . |
| 4,566,698 | 1/1986 | Sneden . |
| 4,706,960 | 11/1987 | Nowacki . |
| 4,773,651 | 9/1988 | Papapavlou . |
| 5,120,066 | 6/1992 | Cohen . |
| 5,356,153 | 10/1994 | Morse . |
| 5,472,207 | 12/1995 | Sullivan . |
| 5,813,671 | 9/1998 | Barratt . |
| 5,826,877 | 10/1998 | Glassman . |
| 5,895,050 | 4/1999 | Dodd . |
| 5,913,519 | 6/1999 | Sindelar . |
| 5,951,010 | 9/1999 | Ordinas . |

*Primary Examiner*—Jeanette Chapman
*Assistant Examiner*—Vishu Mendiratta
*Attorney, Agent, or Firm*—Reed Smith Shaw & McClay LLP

[57] ABSTRACT

A corporate ladder game is provided which includes a playing surface having a plurality of corporate ladders. Each ladder has a plurality of corporate steps or rungs beginning with a first step designated as trainee located at the bottom of the ladder. The top step of each ladder is the position of chief executive officer. The top step is common to all the ladders. A means for indicating a position on each ladder and adapted to be moved from step to step of each ladder is provided for use in playing the game. A means for displaying a plurality of questions and answers used in the game to challenge each player's knowledge of corporate business matters is also provided. Each of the questions and answers has a business related question and a plurality of correct answers associated with each question. Each answer of the plurality of answers has a specific point value. Points which correspond to a correct answer of the question are awarded to players when they select an answer, from a set of answers, which match one of the plurality of answers, so that accumulation by a player of a first predetermined point value will permit movement of that player's position indicator from step to step up the corporate ladder.

14 Claims, 7 Drawing Sheets

CORPORATE LADDER GAME

FIELD OF THE INVENTION

The present invention relates generally to the field of board type games and more particularly to a game relating to the subject of climbing the corporate ladder in order to achieve the objective of reaching the top rung of the ladder, or the position of chief executive officer.

BACKGROUND OF THE INVENTION

Board games are of course well-known. Such games have been known to relate to many topics and subjects. One of the most popular of all board games relates to the subject of real estate transactions and can be used to gain a fundamental knowledge of properties, money transactions and risk taking. Numerous other board games have been devised to focus on other fields of interest. Most such board games include the familiar structural configurations of a playing surface, playing pieces and other elements which can be directed to a large number of topics to achieve a variety of objectives.

While many different types of board games have been devised, none are known to be directed specifically to the objectives of company or corporate ladder climbing whereby, fictitious employees will begin a career in the corporation at a low level, such as trainee, and seek to advance through the ranks, or up the corporate ladder rungs to the highest position. In order to be successful in achieving the objectives of climbing the corporate ladder, one must gain significant knowledge and be able to correctly handle a myriad of questions and problems. In the early part of one's career, an employee is usually faced with problems that are unique and specific to a particular corporate function in which that employee is engaged. As a person's career advances within a corporation, the problems which that employee must deal with typically extend beyond the particular function within which the employee is engaged and relate to general issues of corporate management and business.

While previously known board games relate to many subjects and objectives, including subjects relating to real estate objectives, marketing objectives and other business related objectives, the present invention deals uniquely with the objectives of climbing the corporate ladder and being able to handle problems and answering questions which uniquely develop within a corporation and which must be dealt with in order to successfully climb the corporate ladder. The present invention can be used as a learning tool for actual employees of a corporation, The questions and answers used in the playing of this invention are derived from real life situations and will be formulated by experienced corporate executives.

OBJECTS OF THE INVENTION

It is accordingly a general object of the present invention to provide a board game directed specifically to the task of climbing the corporate ladder with the objective of reaching the top rung of that ladder, which is the position of chief executive officer.

In one embodiment of the invention, the game, which is directed to climbing the corporate ladder, is conducted on a playing surface which is two dimensional and which carries an illustration of corporate ladders with each rung representing a successively higher level or position within the corporation. In this embodiment, a number of ladders are provided on the playing surface to accommodate a plurality of players who compete for the top position. While a corporation may have many lower level positions, it can have only one chief executive officer position. Accordingly, each ladder on the playing surface will terminate in the same top rung having the title of chief executive officer, so that such top rung is common to each ladder. In this embodiment the plurality of ladders will be radially arranged as spokes on a circular wheel with the hub or the center of that wheel being the top of each ladder.

In yet another embodiment of the invention the game is conducted on a three dimensional playing surface, such as a multi-sided pyramid. In this embodiment, the position of chief executive officer will be located at the apex or the top of the pyramid.

A further object of the invention is to provide means for questions to be presented to the various players. A player will select an answer from a provided set of answers, to such questions and will be awarded value points depending on the selected answer. Upon accumulation of a certain minimum required number of value points, that player can advance to the next level or position up the corporate ladder towards achieving the ultimate goal.

Another specific object of the invention is to provide a board game which can simulate real problems relating to employees advancing their career within a corporation.

Yet another object of the present invention is to provide a corporate ladder game which includes means for challenging the player's knowledge relating to a particular corporate function as well as a player's knowledge of general business and management issues.

Yet another object of the present invention is to provide a corporate ladder climbing game that tests a player's ability to respond to corporate issues within a corporation as are typically found in real life situations, in order to advance within a corporate hierarchy.

A still further specific object of the present invention is to provide a corporate ladder climbing game that places one player in competition with other players in the quest to reach the top spot of chief executive officer by correctly answering numerous questions relating to corporate business activities.

A further object of the present invention is to provide a board game relating to climbing a corporate ladder that serves to educate players on the fundamentals of corporate career growth and business matters.

Other objects, features and advantages of the present invention will be apparent from the description hereinafter.

BRIEF SUMMARY

This invention is directed to an apparatus and a method of playing a board game relating to the subject of climbing a corporate ladder with the objective of reaching the top position of chief executive officer. The corporate ladder game includes a playing surface which can be either a two dimensional playing surface such as a flat board, a three dimensional playing surface such as a multi-sided pyramid or an electronic playing surface which can be viewed on a screen of a personal computer and which can be controlled by a central processing unit having a program with appropriate software that permits the players to operate on the screen. The playing surface has a plurality of corporate ladders. Each ladder is designated by a particular corporate function, and each ladder can be distinguished from the other ladders by color. Each of the ladders on the playing surface will have a plurality of separate corporate steps or rungs, beginning at one end thereof with a first step, which may be designated as trainee, then assistant supervisor, supervisor, manager, director, assistant vice president, senior vice president, executive vice president, division president, and ultimately a final or top corporate step designated by the position of chief executive officer. Because there can only be one chief executive officer in a corporation, the various ladders depicted or structured on the playing surface will all terminate at a common top position. A plurality of player pieces is provided and adapted to be positioned on and be moved from step to step of the plurality of corporate ladders.

Alternatively, an automated board is provided on which movement of the playing pieces up each ladder is indicated by illumination of lights or light emitting diodes, located on each rung of each ladder.

In its simplified form, each player will be assigned to a particular ladder to be climbed. Questions relating to business issues are displayed for presentation to all players simultaneously. The questions are maintained on question and answer cards. The question will be printed on one side of the card. A plurality (such as four) possible correct answers are printed on the reverse side of the card. Each player will be provided with a set of answer cards identified by numerals, such as "1," "2," "3" or "4." These cards will correspond to one of the answers on the reverse side of the question card. Each correct answer on the question card will have a certain number of points associated with it. When all players have selected an answer, the players will all reveal their selected answer at the same time. Each player will earn the points associated with the answer selected by that player.

Once a player has accumulated a certain minimum amount of points that player will be permitted to move up that player's designated ladder to the next succeeding rung or position. The player to first reach the top rung on that player's assigned ladder will achieve the position of chief executive officer and win the game.

In the automated version of the game, questions and answers are carried by a CD ROM and are displayed on a central screen. Selection indicators will be displayed on a separate concealed screen for each player. Selection of answers are accomplished by pressing answer buttons. Points for selected answers will be automatically accumulated and tallied for each ladder. Movement up a ladder will be indicated by illumination of the rung lights.

In a more complex form of the game, different sets of question and answer cards, which are specific to each of the various corporate functions, and which are color coded to correspond to the colors of the various ladders, are provided. Each card within each set will contain a question relating to the activity of the function represented by a specific corporate ladder, such as the legal function, sales and marketing function, operations function, etc. Each card will also contain up to four possible correct answers to the question. Questions will similarly typically be printed on one side of the card while the answers are printed on the reverse side. Each printed correct answer will have a certain point value associated with it. Upon a player selecting an answer from four possible answer cards, that player will earn the pont value for the answer printed on the card which corresponds to that player's selected response.

Once a player achieves a particular level on the ladder, such as the level of vice president, he will be challenged to continue climbing the ladder by having to select answers to questions relating to general business and management issues. The general business and management questions are taken from a set of question and answer cards which are not specific to any particular corporate function. Correct selected answers to these questions will also result in the award of corporate perks which carry a particular point value depending on the answer given.

The rules of the game will designate a minimum number of accumulated points required to advance up the corporate ladder. For example, in order to be promoted for each level from trainee up to vice president, a player will need to have earned eight points. Beyond the position of vice president, a player will need to have earned more then eight points (such as twelve points) to be promoted to each higher position, and will have to earn sixteen points to be promoted from division president to the position of chief executive officer.

The foregoing and other features of the present invention are more fully described with reference to the following drawings annexed hereto.

BRIEF DESCRIPTION OF THE DRAWINGS

FIGS. 4(*a*) and 4(*b*) are plan views which illustrate opposite sides of a question and answer card which is contained within the holder shown in FIG. 4;

FIG. 4(*c*) illustrates four answer selection cards used with the question and answer cards shown in FIG. 4;

FIGS. 6(*a*) and 6(*b*) illustrate opposite sides of a question and answer card which is contained within the sets shown in FIG. 6;

FIG. 6(*c*) illustrates four answer selection cards used with the question and answer cards shown in FIG. 6;

FIGS. 7(*a*) and 7(*b*) illustrate opposite sides of a question and answer card contained in the set of cards shown in FIG. 7;

FIG. 7(*c*) illustrates four answer selection cards used with the question and answer cards shown in FIG. 7;

DESCRIPTION OF THE PREFERRED EMBODIMENTS

Figure 1:
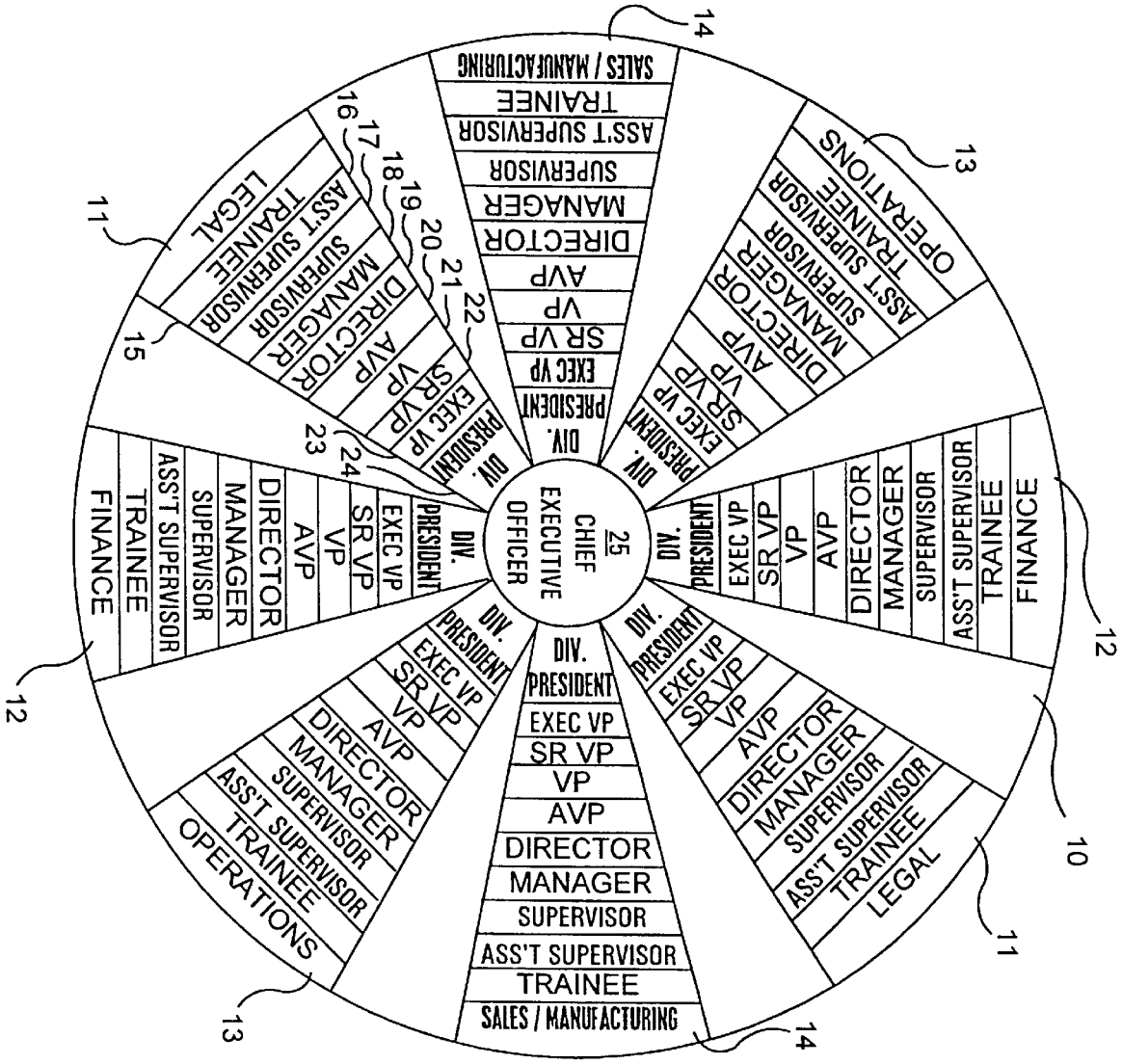
FIG. 1 is a plan view illustrating one embodiment of the present invention in which the playing surface is a two dimensional board and illustrating thereon a plurality of corporate ladders.

Referring now to the drawings, and with particular reference to FIG. 1, reference numeral 10 denotes a generally circular two dimensional board type playing surface. The playing surface 10 has illustrations thereon of a plurality of radially arranged ladders 11, 12, 13 and 14. In the embodiment illustrated in FIG. 1, there are two sets of such ladders, or a total of 8 ladders radially arranged about the circular playing surface 10. Each ladder is designated by a particular corporate function. For example, ladder 11 is designated as a legal corporate function, ladder 12 is the finance corporate function, ladder 13 is an operations function and ladder 14 is a sales and marketing function. Numerous other corporate functions can be imagined and utilized in this invention. Each corporate ladder has 10 rungs or steps 15,16,17,18,19, 20,21,22,23 and 24. Each rung represents a level or position in a typical corporate hierarchy. Each ladder contains the same positions, beginning with trainee 15. Moving up the corporate ladder the various positions include assistant supervisor 16, supervisor 17, manager 18, director 19, assistant vice president 20, vice president 21, senior vice president 22, executive vice president 23 and division president 24. The final step on each ladder is the top rung, chief executive officer 25. Because there can be only one chief executive officer in any corporation, the top rung representing the chief executive officer position 25 is common to each ladder 11, 12, 13 and 14. Accordingly, the top position of each ladder is located at the center of the circular board 10. The board 10, therefore, has the appearance of a wheel having a hub which is represented by the top position 25 or the chief executive officer, with each of the ladders corresponding to a spoke of that wheel.

In order to distinguish one corporate function from the others, each corporate ladder will be illustrated in a different color. So for example, the legal function corporate ladder 11 will be red, the finance corporate ladder 12 will be blue, the operations corporate ladder 13 will be green and the sales and marketing corporate ladder 14 will be yellow. In an arrangement having two sets of the same functions, such as shown in FIG. 1, each ladder of the same function will also have the same color. The purpose and function of each ladder being illustrated in a different color will be described more fully in connection with the process of playing the game according to one embodiment described below.

Figure 3:
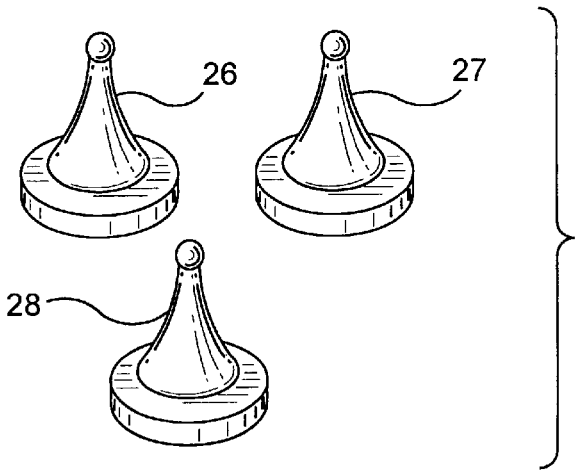
FIG. 3 is a perspective view of playing pieces which may be used for playing the game.

Playing pieces 26, 27 and 28 illustrated in FIG. 3 can be used by the various players of the game to indicate the position that a particular player occupies on that player's respective corporate ladder. To play the game, each player is assigned a particular corporate ladder. Each player will have a particular playing piece for movement up that player's respective ladder. The playing pieces illustrated in FIG. 3 are typical of board games which are known in the art, however, a more appropriate type of player piece could be depicted as a figure of a man or a woman dressed in corporate type attire. The first player to successfully move his playing piece from rung to rung, beginning with rung 15 of his respective ladder through the various positions of the corporation to the top rung, in order to obtain the position of chief executive officer, will win the game.

Figure 2:
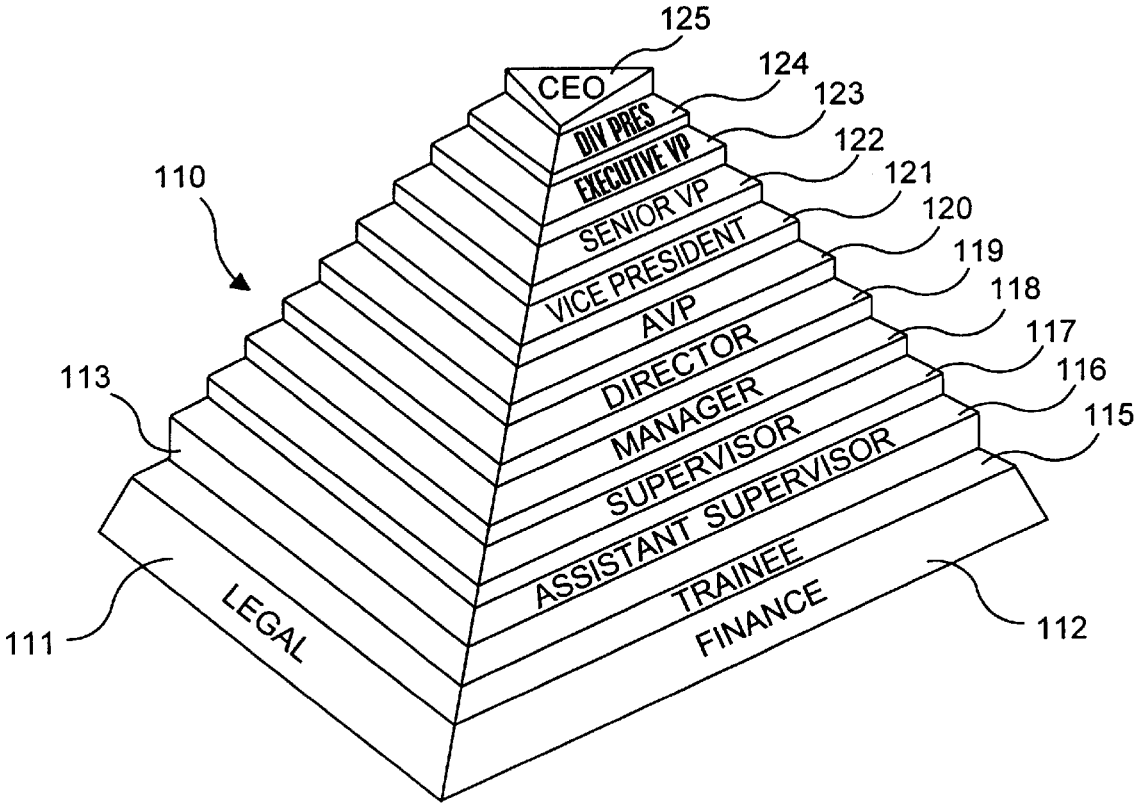
FIG. 2 is a perspective view of another embodiment of the present invention in which the plurality of corporate ladders are located on the inclined side surfaces of a three dimensional pyramid.

FIG. 2 illustrates an alternative embodiment of a playing surface for playing the game of the present invention. In this embodiment the playing surface is formed by a three dimensional pyramid 100. The pyramid 100 illustrated in FIG. 2 has three sides 111, 112 and 113. Each side has steps 115–125 which correspond to the same corporate positions 15–25 respectively described in connection with the ladders shown in FIG. 1. The three sides of the pyramid 100 terminate at the top with step 125 corresponding to the position of chief executive officer. Each player uses a playing piece, such as the ones illustrated in FIG. 3, to be positioned on each of the steps 115–125 as that player proceeds through the game.

Sides 111, 112 and 113 each have a different color to correspond to a particular corporate function. So for example, side 111 which represents the legal corporate ladder will be colored red, side 112 which may represent the finance corporate function will be colored blue, and side 113 which can represent the operations corporate function will be colored green. While pyramid 100 is illustrated as a three sided pyramid, it may instead have four or more sides to accommodate additional corporate function ladders.

Figure 4:
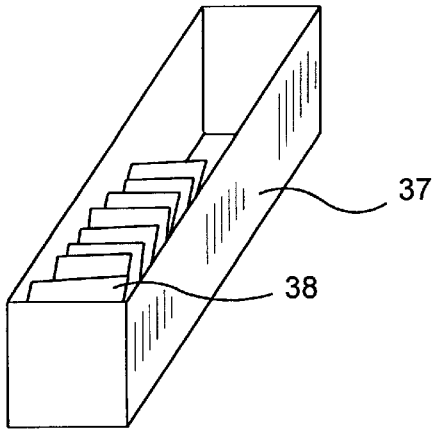
FIG. 4 is a perspective view illustrating a holder which contains question and answer cards used for playing the game of the present invention.
Figure 4A:
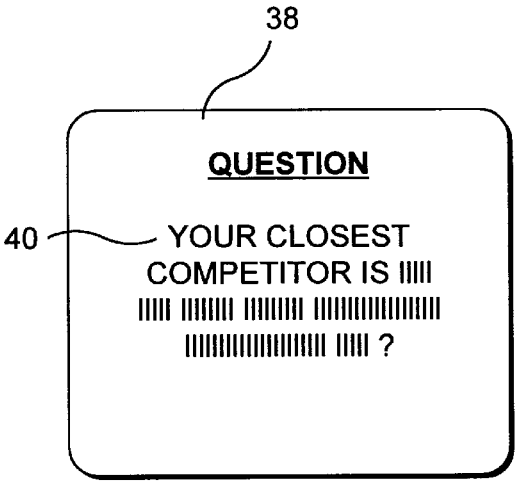
Figure 4B:
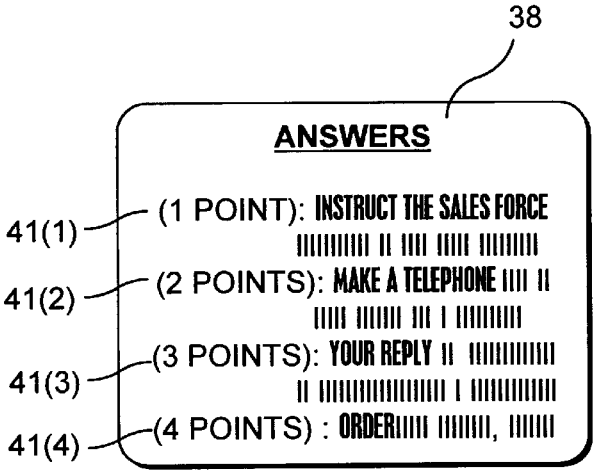
Figure 4C:
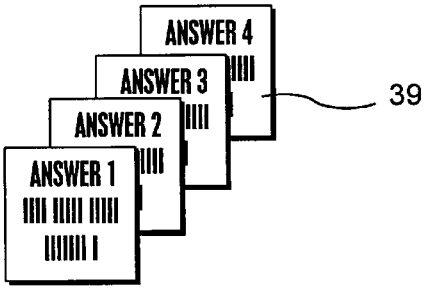

FIG. 4 illustrates question and answer cards 38 contained within a holder or box 37. Each card 38 has a question relating to corporate business issues printed on one side and a plurality of answers printed on the other side. FIG. 4(*a*) illustrates question 40 printed on one side of the card 38 which contains the legend QUESTION. FIG. 4(*b*) illustrates the other side of the card containing the legend ANSWERS. In this embodiment four possible answers 41(1), 41(2), 41(3) and 41(4) are printed. While each answer is a correct answer, some are more correct than others and therefore have different point values. To play a simplified version of the game a designated player will randomly choose one of the question and answer cards 38 from the holder 37 and display only the question side to all the players. Each player will then be provided with four possible answer cards 39, as illustrated in FIG. 4(*c*). Each player will receive an identical set. Each of the answer cards 39 will have a different answer printed on it. Each answer card will have the same answer as one of the four possible answers printed on the reverse side of the question and answer card 38. Each card 39 in the set of answer cards shown in FIG. 4(*c*) is separately identified by numerals such as "1," "2," "3," or "4." This numbered card will correspond to the numbered answers printed on the reverse side of the question and answer card 38. Each player will select one of the four possible answers. When all of the players have selected their answers, they will simultaneously display their selected answers for the other players to see. Each player will be credited with or awarded the number of points which his/her selected answer is identical to, as indicated on the answer side of the question and answer card 38. In this manner, the various players will accumulate points upon selecting answers to each of the displayed questions. Upon accumulating a certain minimum number of points, each player will be permitted to advance his or her respective playing piece from rung to rung toward the goal of chief executive officer. The first player to achieve the deposition of chief executive officer will win the game.

Figure 8:
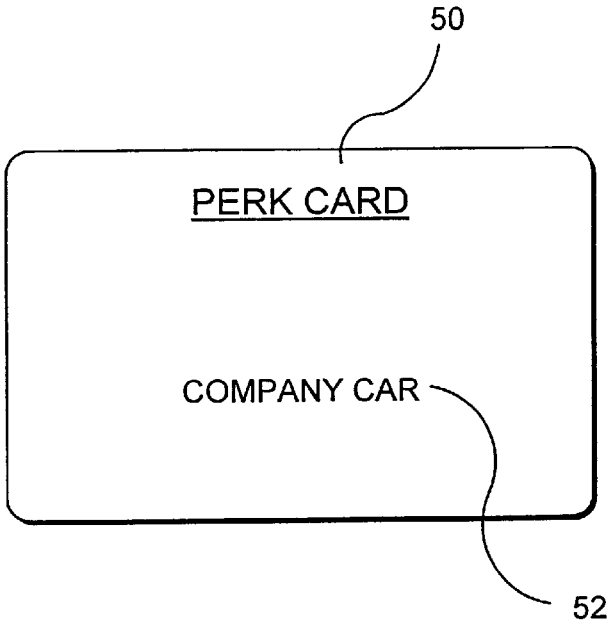
FIG. 8 illustrates a perk card used in playing the game of the present invention.

An additional feature of the game according to the present invention will be the award of perk cards, such as illustrated in FIG. 8. Each perk card will have a particular type of perk such as company car, country club membership, etc. associated with each card.

Figure 5:
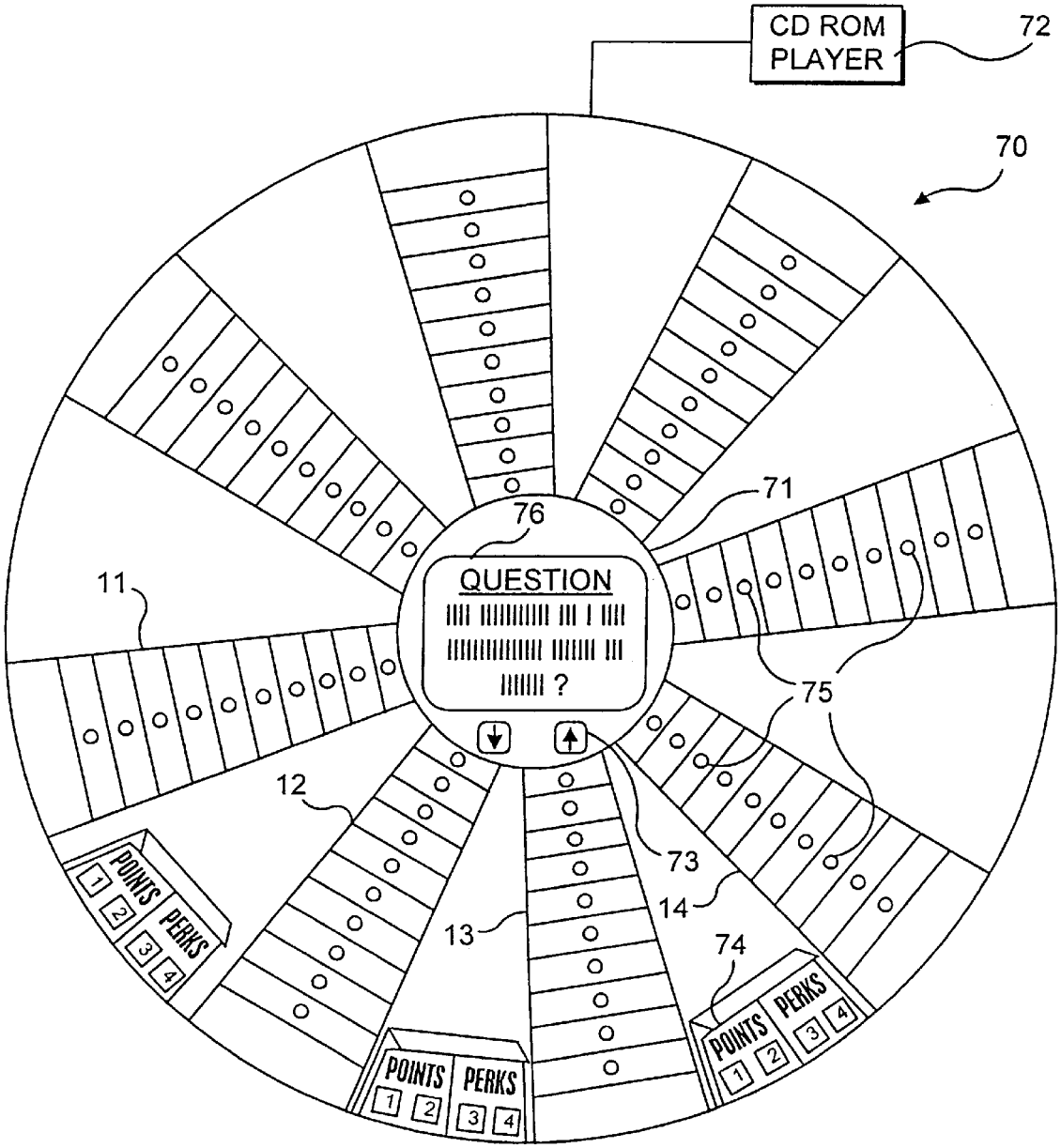
FIG. 5 is a plan and partial schematic view illustrating an automated playing surface of the present invention.

An automated playing surface 70 is illustrated in FIG. 5. Playing surface 70 will have a plurality of corporate ladders 11, 12, 13 . . . illustrated thereon similar to the board playing surface 10 illustrated in FIG. 1. As in the embodiment of FIG. 1, the ladders 11, 12, 13, . . . are radially arranged about a central hub 71. Hub 71, while functioning as the common chief executive officer position, also supports a display screen 76 upon which questions may be displayed. A CD ROM player 72 is electrically connected to the screen 76, in a manner which is well known in the art, so that the data contained on the CD ROM may be scanned and questions which are carried by the CD ROM may be displayed on the screen 76. Screen 76 is provided with scanning or scroll buttons 73 to choose new questions. In a manner similar to the manner described in connection with the embodiment of FIG. 1, each player will be assigned a particular ladder. The automated board of FIG. 5 is provided with a concealed screen 74 which only a particular player may view. The concealed screen 74 is used for displaying accumulation of points and perks. In addition to displaying questions on the central screen 76, the screen will also display four possible numbered answers. The concealed screen 74 also has selection buttons 1, 2, 3, and 4. To select a particular answer, each player will press one of the selection buttons. Once all of the players have pushed a selected answer button on their respective concealed screens, each player will be credited with or awarded the points associated with the selected answer automatically. When the minimum required number of points for moving from one rung to another is achieved, lights 75 will be illuminated according to the number of points accumulated by each player.

The use of the automated board illustrated in FIG. 5, facilitates the supply of additional questions and answers by the sale of supplemental CD's.

The game of the present invention can also be supplemented by adding additional questions and answers which can be downloaded from a supplier site on the internet. Players of the game will be able to locate an internet site that has a data base of questions and answers. Players are able to test the use of such additional questions and answers directly on the internet by having limited access to such additional questions and answers. Then, players are able to purchase sets of additional questions and answers directly from the supplier site on the internet in the usual manner. Once purchased, the additional questions and answers can be downloaded for use by the players.

A more complex variation of the game described above is illustrated in connection with FIGS. 6 and 7.

Figure 6:
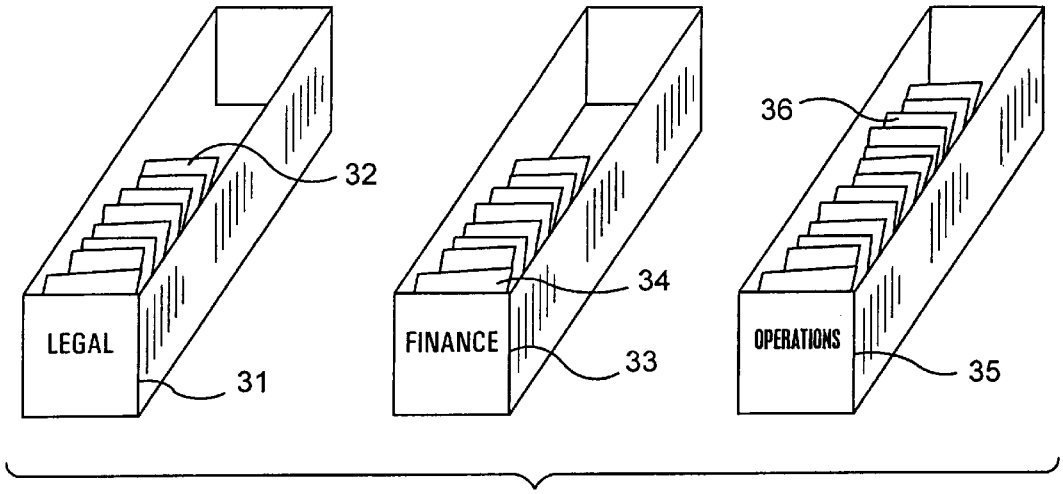
FIG. 6 is a perspective view illustrating a plurality of holders which contain sets of question and answer cards used for playing the game of one embodiment of the present invention.
Figure 6A:
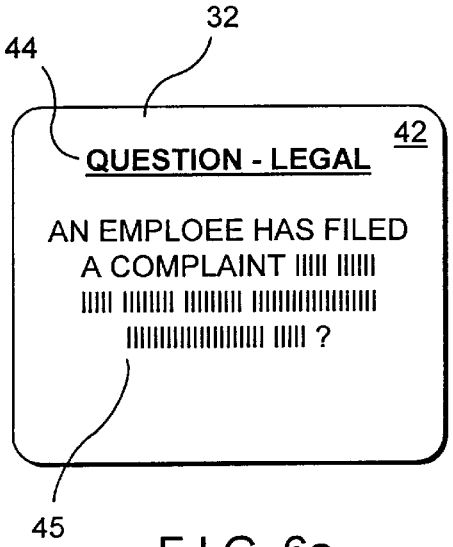
Figure 6B:
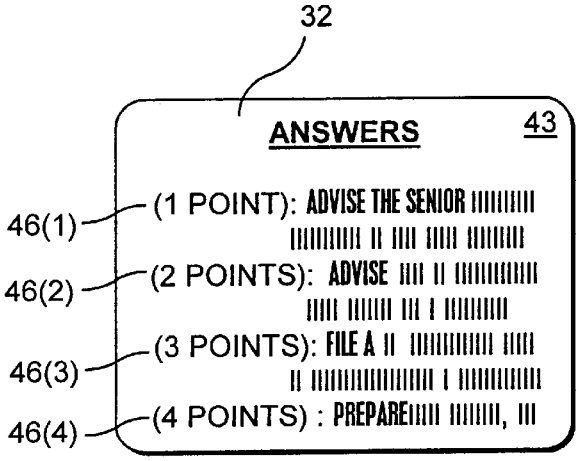
Figure 6C:
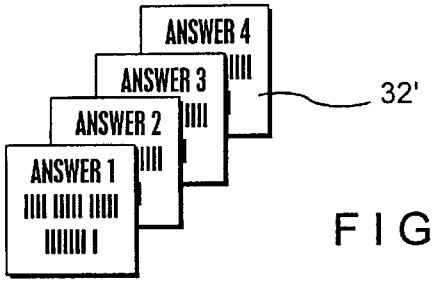

FIG. 6 illustrates three sets of question and answer cards, each set of cards being contained within a holder. Each set of question and answer cards contain questions and answers relating to a particular corporate function. Container 31 contains question and answer cards 32 which have questions and answers relating to the legal corporate function. Container 31 and the cards 32 will therefore have the same color (red) as ladder 11 illustrated on the board 10 or ladder 111 on a side of the pyramid playing surface 100. Container 33 carries question and answer cards 34 which relate to the finance function and therefore both the box and it's cards will be colored blue to correspond to ladder 12 of board 10 or side 112 of pyramid 100. Similarly, container 35 contains question and answer cards 36 which relate to the operations function and therefore both the container 35 and its cards 36 will be colored green to correspond with the operations corporate ladder 13 of board 10 or the operations ladder side 113 of the pyramid 100. Additional boxes or containers of question and answer cards corresponding to additional corporate functions can also be provided if additional ladders having different corporate functions are incorporated in the game.

To play this version of the game, a player will choose a particular player piece and will choose or be assigned to a particular corporate ladder. Each player will place his player piece on the first rung of his respective ladder, i.e. the trainee position 15. Each player in turn will choose a question and answer card from the container relating to the particular corporate ladder or function that player has chosen. For example, the player seeking to ascend the legal corporate ladder 11 will choose a question and answer card 32 from it's container 31. To avoid mistakes, the legal container 31 and it's respective cards 32 are color coded the same as the color of legal corporate ladder 11, in the example given above, the red color. FIGS. 6(*a*) and 6(*b*) illustrate an example of a card 32. The front face 42 of the card 32 is illustrated in FIG. 6(*a*) and the opposite face 43 of the card 32 is illustrated in FIG. 6(*b*). Both faces will contain a legend 44 designating the particular function or ladder to which this card relates. In the illustration shown in FIGS. 6(*a*) and 6(*b*), the card 32 will have the legend "LEGAL". The front face 42 of the card 32 will contain a question 45 relating to the legal activities of the corporation. The opposite side 43 of card 32 will contain four possible answers 46(1), 46(2), 46(3) and 46(4) which are each correct to some degree. While each answer is correct to a degree, one of the answers 46(4) is the best answer, or most correct and therefore has a four point value. Answer 46(1) will be least correct and thus has only a one point value. Answers 46(2) and 46(3) have two point and three point values respectively. In assembling the questions and answers for each function, industry leaders will be consulted to provide their views of appropriate questions and answers.

In playing the game, a first player will select a question and answer card from the box or the container corresponding to the functional ladder associated with that player. So for example, the player ascending ladder 11, the legal ladder, will choose a card 32 from the box 31. Upon viewing the question 45, the player will be permitted to select an answer from one of four answer cards 32' as shown in FIG. 6(*c*). Each answer card will match one of the answers 46(1)–46(4) on the reverse side 43 of card 32, and that player will be awarded the point value of his matching answer.

Each player will also receive a perk card 50, such as illustrated in FIG. 8. Each perk card will have a corporate perk 52. Perk card 50 shown in FIG. 8, by way of example, represents a company car perk.

Each player in turn will select a question and answer card from the container associated with that player's particular ladder. The player ascending the finance ladder will choose a card 34 from the finance box 33, and a player ascending the operations ladder will choose a card 36 from the operations container 35. A box containing cards relating to a sales and marketing function (not shown) will also be provided if the playing surface has a sales and marketing ladder. The players will thus select the question and answer cards and will also then select from the group of four answers, an answer which that player believes is most correct. The players will accumulate point values depending on the answers they select. Upon achieving a minimum number of points, a player will be permitted to move it's playing piece from the lower most rung 15 to the next succeeding rung 16 corresponding to the position of assistant supervisor. The players can agree on the minimum number of points which will be required for such a move. For example, a player must achieve and accumulate eight points to move from one rung to the next.

Figure 7:
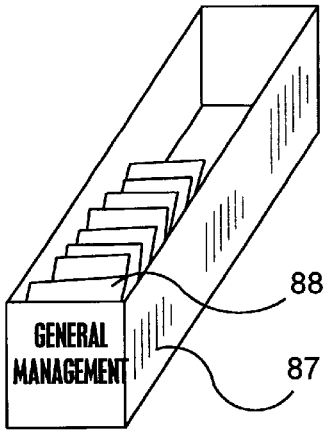
FIG. 7 is a perspective view illustrating a set of question and answer cards relating to general management issues which are used in playing the game of the present invention.
Figure 7A:
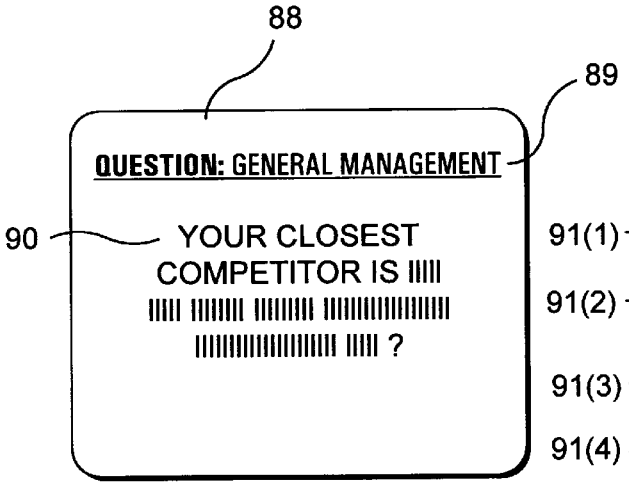
Figure 7B:
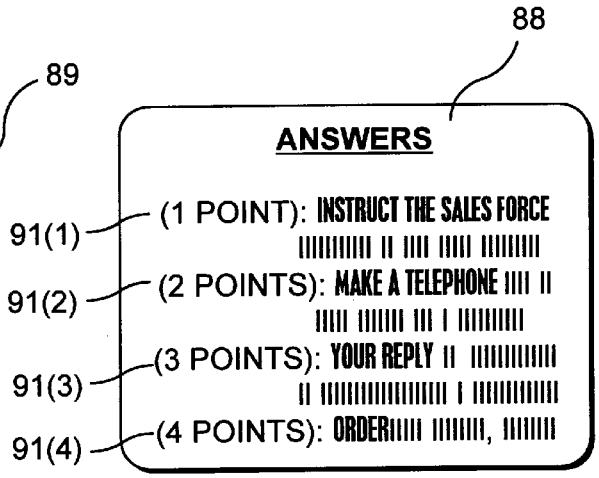
Figure 7C:
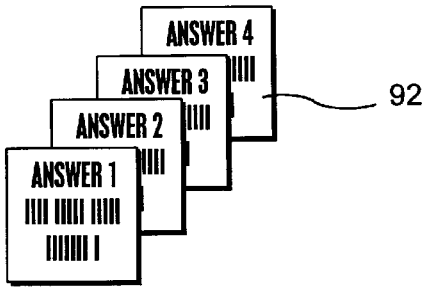

As in real life, once achieving a certain level within a corporation, career advancement depends upon a person's abilities in areas of general management and general business rather than solely within that person's area of expertise in a particular corporate function. Accordingly, once that person reaches the vice president level, subsequent questions and answers should be chosen from a set of question and answer cards 88 from a box 87 which relate to areas of general management. An example of a card 88 is illustrated in FIGS. 7(*a*) and 7(*b*). As with the functional ladder specific questions, an example of which is shown in FIGS. 6(*a*) and 6(*b*), the questions from general management relate to issues concerning senior managers of any corporation. Cards 88 accordingly will have a designation or legend 89 indicating that it is a GENERAL MANAGEMENT card. Questions 90 on one side of the card shown on FIG. 7(*a*) and it's respective possible four answers 91(1), 91(2), 91(3) and 91(4) on the other side of card 88, shown in FIG. 7(*b*), will therefore relate to issues concerned with senior managers such as vice presidents and above. When a player reaches the level of vice president on that player's ladder, that player will then have to select a question from the general management box 88. An answer selected from answer cards 92 shown in FIG. 7(*c*) will again result in an award of points corresponding to the matched answer on the answer side of card 88. A perk card will also be awarded. Once again, the players can decide how many points will be required to advance up the corporate ladder beyond the vice president level. For example, to be promoted from one rung to the next after achieving the vice president level will require twelve points. Similarly, once the player reaches the level of division president, a higher number of points will be required to achieve the ultimate goal of chief executive officer. For example, to be promoted from division president to chief executive officer will require sixteen points.

Figure 9:
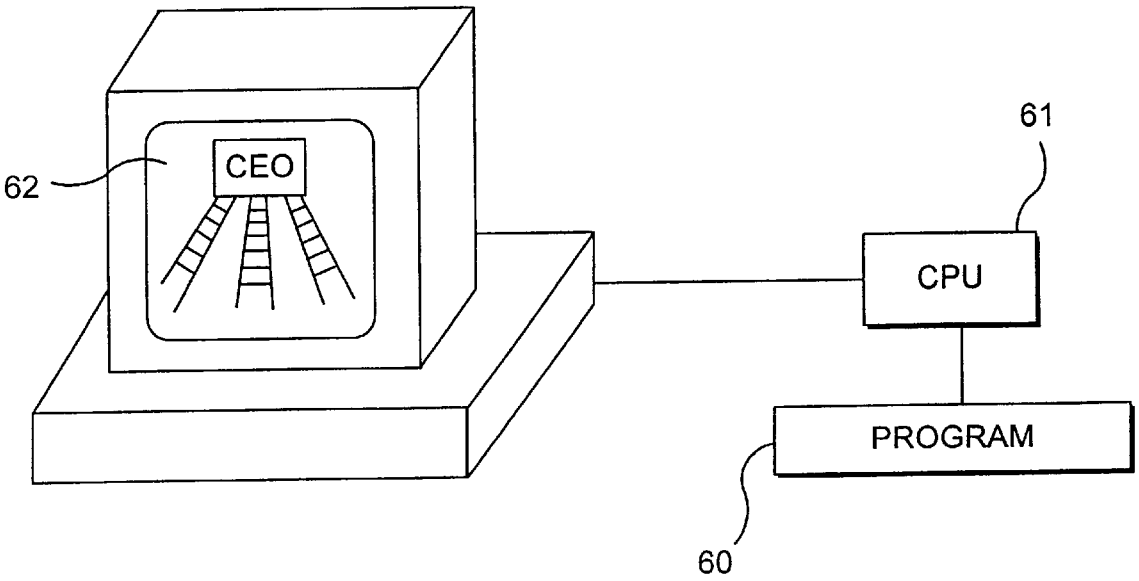
FIG. 9 is a block diagram illustrating another embodiment of the present invention.

The game of the present invention has heretofore been described in connection with a playing surface either on a two dimensional board 10, as shown in FIG. 1, or a three dimensional structure, such as pyramid 100 shown in FIG. 2, as an automated board 70 as shown in FIG. 5. The operations and various features of the present invention however may be contained within a computer software program. FIG. 9 illustrates such an arrangement. Program 60 will operate through a central computing unit 61. The various features of the game are displayed on a computer terminal 62. The program 60 will consist of source code containing numerous questions and answers which can be selected electronically. Selected answers will similarly result in perks point values which can be designated to particular players on a score card electronically maintained by the program. The program 60 can be contained on a floppy disk or compact disk which can be read by most personal computers.

The invention has been described and illustrated in connection with certain preferred embodiments which illustrate the principals of the invention. However, it should be understood that various modifications and changes may readily occur to those skilled in the art, and it is not intended to limit the invention to the construction and operation of the embodiment shown and described herein. Accordingly, additional modifications and equivalents may be considered as falling within the scope of the invention as the defined by the claims hereinbelow.

What is claim is:

1. A corporate ladder game, comprising:

a playing surface defining a plurality of corporate ladders, each said ladder being designated by a specific corporate function and each said ladder having a specific color;

each ladder having a plurality of corporate steps beginning with a first step designated as trainee being located at the bottom of said ladder, and each ladder having a top step designated by the position of chief executive officer;

a plurality of player pieces adapted to be positioned on and moved from step to step of each said ladder;

a plurality of ladder specific sets of question and answer cards, each said set being color coded corresponding to the colors of said ladders, said question and answer cards having printed thereon questions and answers which relate to activities specific to said corporate function represented by a specific ladder, said ladder specific questions and answers being used until a player reaches a first predetermined step on its respective ladder;

a set of ladder non-specific question and answer cards having a color unrelated to any of said plurality of ladders, said non specific question and answer cards having printed thereon questions and answers which relate to matters of general corporate business and management, said non-specific question and answer cards being used when player pieces reach said first predetermined level on its respective ladder;

a set of answer cards associated with each question and answer card, said answer cards each having an answer which matches one of the answers on said question and answer card;

each of said answers on said question and answer cards having a point value;

whereby points are awarded to players upon selecting an answer card which matches answers on said question and answer cards, so that accumulation by a player of a first point value will permit movement of said player's player piece from step to step up the corporate ladder.

2. The corporate ladder game according to claim 1 wherein said playing surface is a two dimensional board, said corporate ladders being illustrated thereon.

3. The corporate ladder game according to claim 2 wherein the top position of chief executive officer of each ladder is common to all of said ladders.

4. The corporate ladder game according to claim 3 wherein said ladders are radially arranged about a circle with said top position located at the center of said circle.

5. The corporate ladder game according to claim 1 wherein said playing surface is an electronic screen, and further comprising a software program having instructions and source code permitting the playing of said game electronically.

6. The corporate ladder game according to claim 1 wherein said playing surface is a three dimensional multi-sided pyramid, each side of said pyramid defining a different corporate ladder, said steps being formed into the inclined surface of each side of said pyramid.

7. The corporate ladder game according to claim 6 wherein the top position of chief executive officer of each ladder is common to all the ladders and is located at the top of said pyramid.

8. The corporate ladder game according to claim 1 wherein each ladder comprises the steps of trainee, assistant supervisor, supervisor, manager, director, assistant vice president, vice president, senior vice president, executive vice president, president, and chief executive officer, the position of chief executive officer being common to all the ladders.

9. The corporate ladder game according to claim 8 wherein said ladder specific question and answer cards are used until a player reaches the position of vice president of a specific ladder, and said ladder non-specific question and answer cards are used from the position of vice president and above.

10. The corporate ladder game according to claim 9 wherein each question and answer card has a single quesiton on one side thereof and a plurality of answers on the other side thereof, each said answer of said plurality of answers having a specific point value, a selected answer to said question from said answer cards results in the award of a point value corresponding to the correct answer.

11. The corporate ladder game according to claim 10 wherein said corporate functions of said plurality of ladders include a legal function, a finance function, on an operations function.

12. The corporate ladder game according to claim 11 further comprising a ladder having the corporate function of sales and marketing.

13. The corporate ladder game according to claim 10 further comprising a holder for each set of ladder specific question and answer cards and a holder for said set of ladder non-specific question and answer cards.

14. The corporate ladder game according to claim 13 wherein each said holder has the same color as said question and answer cards contained therein.

* * * * *